US006418277B1

(12) United States Patent
Golan

(10) Patent No.: US 6,418,277 B1
(45) Date of Patent: Jul. 9, 2002

(54) IMMERSIBLE PTC HEATING DEVICE

(75) Inventor: Gad Golan, Hod Hasharon (IL)

(73) Assignee: A.T.C.T. Advanced Thermal Chips Technologies Ltd., Tel Aviv (IL)

( * ) Notice: Subject to any disclaimer, the term of this patent is extended or adjusted under 35 U.S.C. 154(b) by 0 days.

(21) Appl. No.: 09/529,115

(22) PCT Filed: Oct. 1, 1998

(86) PCT No.: PCT/IL98/00480

§ 371 (c)(1),
(2), (4) Date: Apr. 7, 2000

(87) PCT Pub. No.: WO99/18756

PCT Pub. Date: Apr. 15, 1999

(30) Foreign Application Priority Data

Oct. 7, 1997 (IL) ..... 121915

(51) Int. Cl.[7] ..... H05B 3/06
(52) U.S. Cl. ..... 392/502; 219/540; 338/22 R
(58) Field of Search ..... 219/505, 530, 219/540, 541, 544, 536, 537; 392/502, 498; 338/22 R, 20, 13

(56) References Cited

U.S. PATENT DOCUMENTS 4,177,375 A 12/1979 Meixner
4,482,801 A 11/1984 Habata et al.
5,436,609 A 7/1995 Chan et al.

*Primary Examiner*—Joseph Phelham
*Assistant Examiner*—Thor Campbell
(74) *Attorney, Agent, or Firm*—G. E. Ehrlich Ltd.

(57) ABSTRACT

An electrical heating device (10) for heating liquids employing one or more positive temperature coefficient (PTC) thermistors as heating elements (11). These heating elements (11) are in direct thermal and electrical contact on opposing sides (22), which are coated with a conductive metal such as aluminum, with electrodes to supply electrical current. These electrodes are in turn in direct thermal contact on their outward-facing sides with respect to the heating elements with plates (15) which are formed of a thermally conductive and electrically insulating ceramic material such as AL203, and the plates are in direct thermal contact on their outward-facing sides with respect to the heating elements with heat radiation units (20) which include cooling fins for heat transfer. The heating elements are positioned by an electrically and thermally insulating frame made of heat-resistant material which serves, together with the radiation units, to fully enclose the heating elements, thereby preventing liquid from entering the interior of the device, thus rendering it immersible.

9 Claims, 3 Drawing Sheets

IMMERSIBLE PTC HEATING DEVICE

FIELD OF THE INVENTION

The present invention relates to electrical heating devices for heating liquids, particularly those employing thermistors with positive temperature coefficient of resistance (PTC) as heating elements.

BACKGROUND OF THE INVENTION

Positive temperature coefficient (PTC) heating elements, such as thermistors, are used in electrical heating devices, such as electrical radiators, electrical heating fans, and air conditioner heaters. They have an advantage over electric wire heaters in that they are self-regulating as to temperature and thus are not subject to overheating even in response to abnormal electric currents. In many prior art applications employing PTC thermistor heating elements, heat is extracted from the device by air flow through the device, including the heating elements and radiating elements, such as radiating fins. PTC heating elements, however, are very sensitive to temperature variations, even those caused by air flow across them, due to the "pinch effect" (current displacement), which causes reduced heating efficiency and generating power and reduces their lifetime. As will be appreciated by persons skilled in the art, this problem is more severe for applications wherein the PTC device is used to heat a liquid.

U.S. Pat. Nos. 5,598,502 and 5,471,034 disclose PTC thermistor devices for heating liquids wherein the PTC heating elements are enclosed. In both these cases, the devices disclosed have thermal resistance between the PTC elements and heat transfer members that reduces their heat transfer efficiency and, thus, their power output. The former device has the additional disadvantage of not being fully immersible. The latter device employs channels for the liquid through heat transfer members, which complicates their construction and integration into liquid systems to be heated.

SUMMARY OF THE INVENTION

The present invention seeks to provide an electrical heating device for heating liquids employing positive temperature coefficient (PTC) thermistors as heating elements, which overcomes disadvantages of known art by providing a total enclosure for the PTC heating elements and low thermal resistance between the heating elements and the radiator elements. These features allow a heating device that is totally immersible with efficient internal heat transfer, high power output, and long life.

There is thus provided, in accordance with a preferred embodiment of the invention, an electrical heating device for heating liquids employing one or more positive temperature coefficient (PTC) thermistors as heating elements. These heating elements are in direct thermal and electrical contact on opposing sides, which are coated with a conductive metal such as aluminum, with electrodes to supply electrical current. These electrodes are, in turn, in direct thermal contact on their outward-facing sides with respect to the heating elements with plates which are formed of a thermally conductive and electrically insulating ceramic material such as $AL_2O_3$, and the plates are in direct thermal contact on their outward-facing sides with respect to the heating elements with heat radiation units which include cooling fins for heat transfer. The heating elements are positioned by an electrically and thermally insulating frame made of heat-resistant material which serves, together with the radiation units, to fully enclose the heating elements, thereby preventing liquid from entering the interior of the device, thus rendering it immersible.

The internal elements of the heating device are further held in place and in good thermal contact with each other by mechanical pressure and by a thermally and electrically conductive adhesive. The insulating plates are coated on their inward-facing with respect to the heating elements with a conductive metal such as aluminum to provide good thermal contact therewith. The conductive coatings on the insulating plates can serve as the electrodes for the device, or the electrodes can optionally be independent elements with a textured surface to provide good thermal contact with adjacent members of the device.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1A:
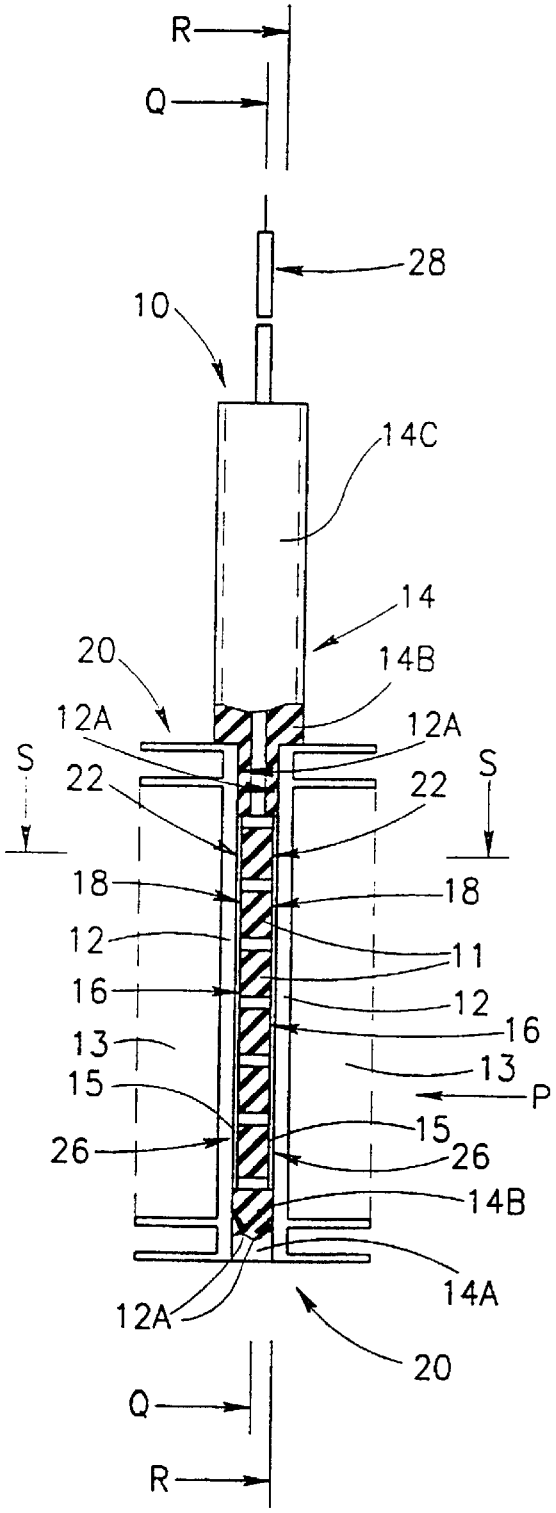
FIG. 1A is a schematic side-sectional view of an electrical heating device constructed and operative in accordance with a preferred embodiment of the present invention.

Referring now to FIGS. 1A through 3, there is shown an electrical heating device referred to generally as 10, constructed in accordance with a preferred embodiment of the present invention. Electrical heating device 10 has an array of one or more heating elements 11 which are positive temperature coefficient (PTC) thermistors. They are fabricated with preferably parallel, generally flat, surfaces on opposing faces 22, which are metallized, preferably by provision of a coating of a conductive metal such as aluminum, to serve as thermal and electrical contact surfaces. On opposing sides of heating elements 11 are plates 15 which are formed of a thermally conductive and electrically insulating ceramic material such as $AL_2O_3$. Inward-facing surfaces 16 of insulating plates 15 are coated with a conductive metal such as aluminum, thereby constituting thermal and electrical contact surfaces.

Figure 1B:
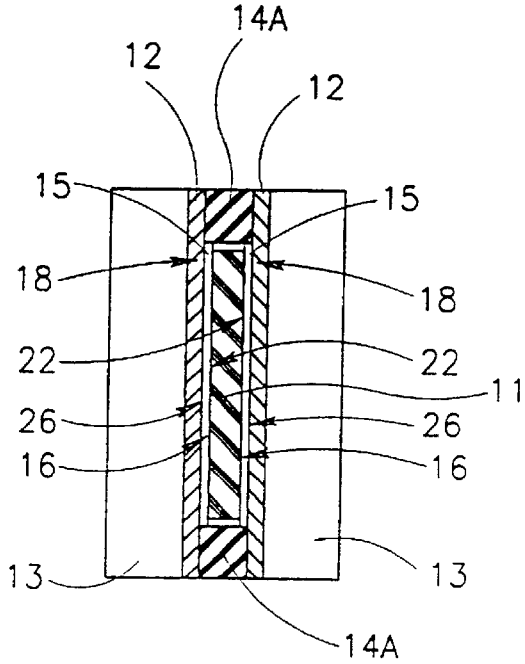
FIG. 1B is a cross-sectional view of the electrical heating device of FIG. 1A, taken along line S—S therein.

In a preferred embodiment of the present invention, shown in FIG. 1B, these coated surfaces 16 of insulating plates 15 serve as electrodes for heating device 10, to supply electrical current to heating elements 11 thereby.

Figure 1C:
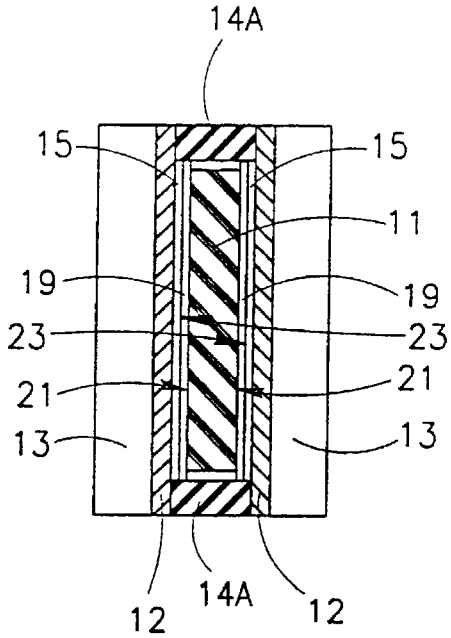
FIG. 1C is a cross-sectional view of the electrical heating device of FIG. 1A, taken along line S—S therein, constructed and operative in accordance with an alternative preferred embodiment of the present invention.

In an alternative preferred embodiment of the present invention, shown in FIG. 1C, there are provided electrodes 19 which are disposed between insulating plates 15 and PTC heating elements 11. Electrodes 19, which, preferably, are provided in conjunction with each of coated surfaces 16 (FIG. 1A), are operative to supply electrical current to heating elements 11. In this embodiment, PTC heating elements 11 are in thermal and electrical contact with electrodes 19 via their metallized surfaces 22 (FIG. 1A). Electrodes 19 are fabricated to have spring-like properties and textured surfaces 21 and 23. Preferably, electrodes 19 are formed of a corrugated springy conductive sheet metal, preferably, aluminum. As will be appreciated by persons skilled in the art, these properties provide especially good mechanical, thermal, and electrical contact, both between electrodes 19 and heating elements 11 and also between electrodes 19 and metallized surfaces 16 of insulating plates 15. The present embodiment is operative to supply generally higher thermal energy output levels than the embodiment shown in FIG. 1B.

Referring now to FIG. 1A, disposed on outward-facing surfaces 26 of insulating plates 15 and in direct thermal contact therewith are heat radiator units, referred to generally as 20, each of which includes a plate 12 and cooling fins 13 extending generally transversely therefrom. Radiator units 20 are made of a material that is a good thermal and electrical conductor, such as aluminum or copper. The plates 12 of the radiator units 20 are fabricated with flat inward-facing surfaces 18 to serve as thermal contact surfaces. The radiator plates 12 are positioned so that the inward-facing contact surfaces are generally parallel to and in touching contact with the outward-facing contact surfaces 26 of insulating plates 15 so as to define thermal interfaces therewith. The conduction across the interfaces is improved by the use thereat of a suitable thermally and electrically conductive adhesive. An example of one material that is adequate for this purpose is Ceramabond™ TM5526, a high-temperature adhesive produced by Aremco Products, Inc. of Ossining, N.Y. 10562, U.S.A.

In accordance with a preferred embodiment of the invention, the adhesive is the novel adhesive developed by the present inventors, disclosed in Israel Patent Application No. 121449. More particularly, the adhesive is an electrically and thermally conductive adhesive composition, in which the adhesive component is essentially a curable silicone prepolymer, and the composition includes finely divided silicon carbide with finely-divided silicon, either separately or in admixture.

The composition is preferably additionally characterized by at least one of the following features, namely:

(i) the finely-divided metallic powder has a particle size no greater than about 40 $\mu$m;

(ii) said finely divided silicon carbide and finely divided silicon have particle sizes no greater than about 14 $\mu$m;

(iii) said finely divided silicon carbide and finely-divided silicon are present in a respective weight ratio of about 0.9 to 1.1: about 1.0;

(iv) the respective weight ratios of said finely-divided metallic powder, said finely divided silicon carbide taken together with finely divided silicon, and said curable silicone prepolymer, are 0.1 (±5%):1.1 (±5%):1 (±5%), and preferably 0.1 (±1%):1.1 (±1%):1 (±1%).

It is also a particularly preferred feature of the present adhesive composition, that the curable silicone prepolymer has a viscosity at ambient temperature within the range 15,000 to 25,000 $\mu$Pa/sec.

PTC thermistor heating elements 11 convert electrical energy applied thereto to thermal energy. The thermal energy is, in turn, conducted from heating elements 11 to cooling fins 13 via electrodes 19, where present, insulating plates 15, all thermal interfaces, and radiator plates 12. When heating device 10 is immersed in a liquid, the thermal energy flows from fins 13 to the liquid.

Figure 2B:
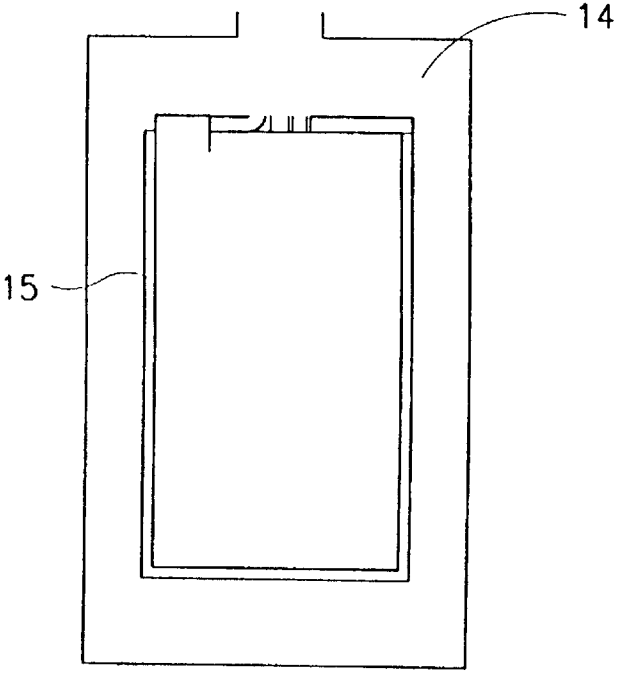
FIG. 2B is a side-sectional view of the electrical heating device of FIG. 1A, taken along line R—R therein.
Figure 2A:
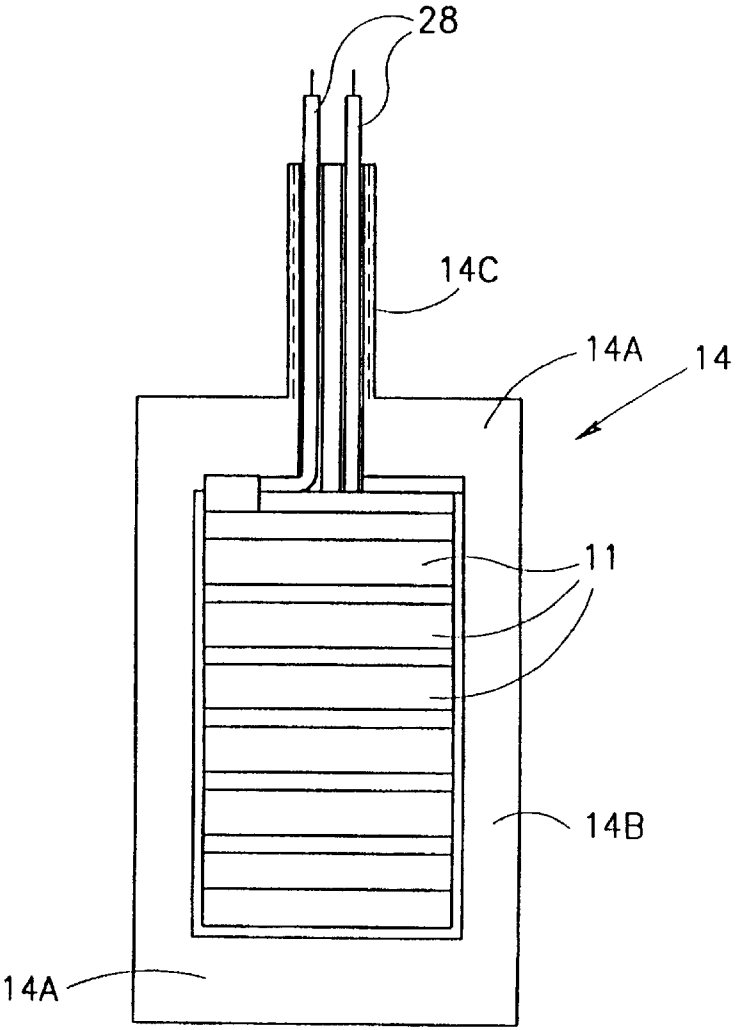
FIG. 2A is a side-sectional view of the electrical heating device of FIG. 1A, taken along line Q—Q therein.

Referring now to FIGS. 2A and 2B, there are shown two side-sectional views of electrical heating device 10 as shown in FIG. 1A, taken along lines Q—Q and R—R therein, respectively. An array of PTC heating elements 11 are positioned by an electrically and thermally insulating frame, referenced generally as 14, made of heat-resistant material. As shown in FIG. 1A, frame 14 has flanges 14A on either side of heating elements 11, and end pieces 14B and a conduit 14C for heat-resistant wires 28 to supply electrical current to heating device 10. The section pictured in FIG. 2B is through insulating plate 15 which is in electrical and thermal contact with heating elements 11 at contact surface 22 on one side thereof, as shown in FIG. 1A.

It can be seen from FIG. 2A that flanges 14A and end pieces 14B and conduit 14C of positioning frame 14 surround the array of heating elements 11 on four sides. Referring again to FIG. 1A, the top flange 14B of positioning frame 14, shown partially cut away, can be seen to enclose the array of heating elements 11 from above, as drawn, and plates 12 of radiator units 20 can be seen to enclose heating elements 11 on both sides longitudinally, as drawn. Plates 12 of radiator units 20 are joined to end pieces 14A of insulating frame 14 and their ends 12A to complete the enclosure of heating elements 11 and of the interior of heating device 10.

In these cross-sectional views, the array of heating elements 11 and the interior of heating device 10 is seen to be completely enclosed by frame 14 and radiator unit plates 12, thereby preventing fluid from entering the interior of heating device 10, thus rendering it immersible.

Figure 3:
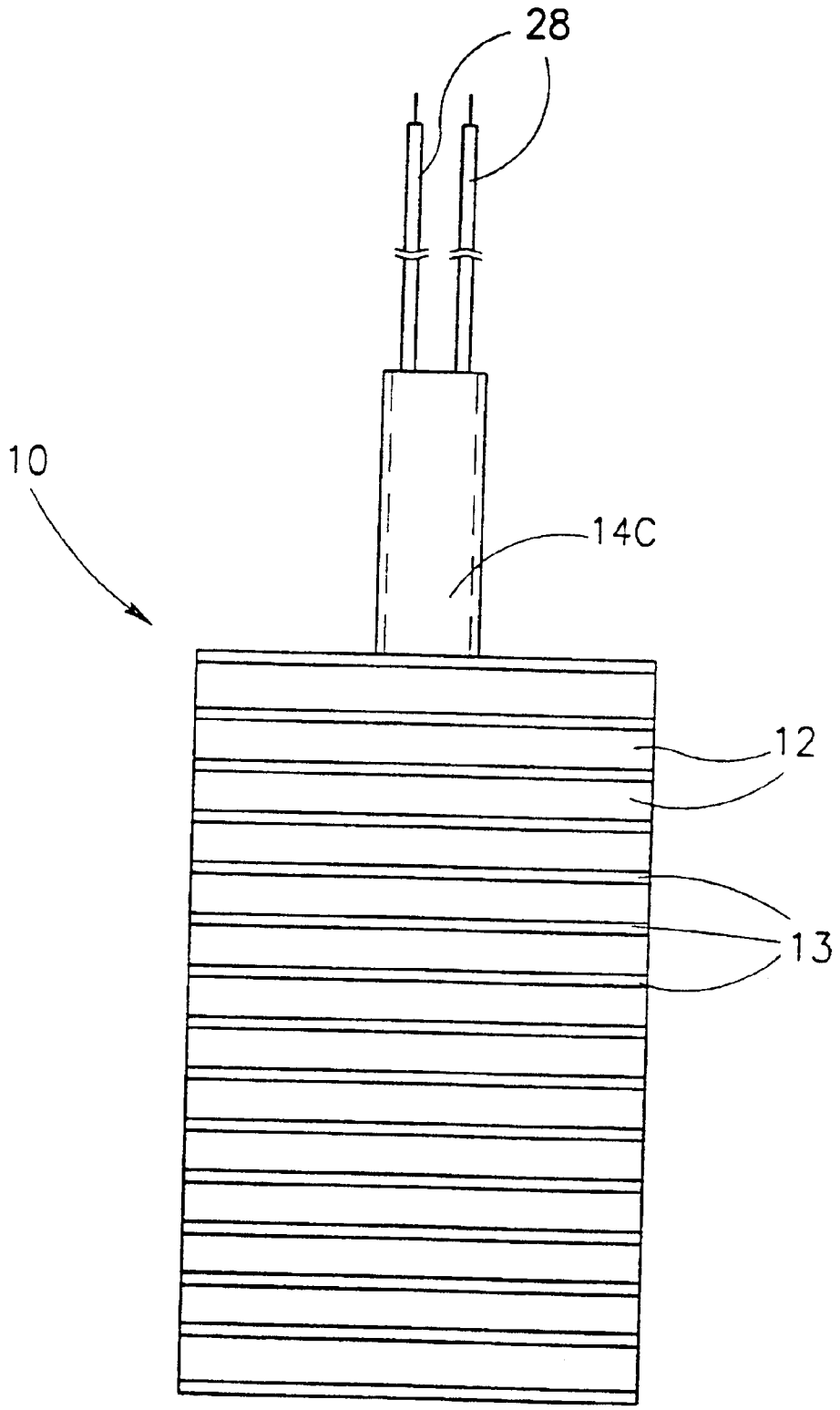
FIG. 3 is a front view of the electrical heating device of FIG. 1A, taken in the direction of arrow P therein.

Referring now to FIG. 3, there is shown a front view of an electrical heating device 10 constructed in accordance with a preferred embodiment of the present invention. In this view is shown one of the radiator units with its plate 12 and fins 13. The drawing also shows conduit 14C of positioning frame 14 with two heat-resistant wires 28 coming out thereof. Heating device 10 as shown is immersible up to the top of conduit 14C of positioning frame 14 which can optionally be constructed with a water-tight seal around heat-resistant wires 28 or packed with a suitable water-tight and heat resistant sealant thereby rendering the device totally immersible.

It will further be appreciated, by persons skilled in the art that the scope of the present invention is not limited by what has been specifically shown and described hereinabove, merely by way of example. Rather, the scope of the present invention is defined solely by the claims, which follow.

I claim:

1. An immersible, electrical device for heating liquids, which comprises:

at least one positive temperature coefficient (PTC) thermistor heating element having generally parallel, flat, contact surfaces;

a pair of plate members formed of an electrically insulating and thermally conductive material having generally parallel, flat, inward- and outward-facing contact surfaces and wherein said inward-facing contact surfaces are coated with a thermally and electrically conductive metal;

a pair of heat radiation members formed of an electrically and thermally conductive material, each comprising:

a plate portion having a generally flat, inward-facing, contact surface for thermally conductive contact with said outward-facing contact surfaces of said plate members and a plurality of generally outwardly extending cooling fins formed on said plate portion;

electrode means about said at least one heating element operative to provide thermally and electrically conductive contact with said contact surfaces thereof and thermally conductive contact with said inward-facing contact surfaces of said plate members;

means for fastening said heat radiation members about said plate members such that said inward-facing, contact surfaces of said plate portions are held in thermally conductive contact with said outward-facing contact surfaces of said plate members thereby to define therewith thermal interfaces, said means for fastening being further operative to fasten said plate members about said electrode means and said electrode means about said at least one heating element such that said inward-facing, contact surfaces of said plate members are held in electrically and thermally conductive contact with said electrode means and said electrode means are held in electrically and thermally conductive contact with said flat contact surfaces of said at least one heating element thereby to define therewith thermo-electric interfaces;

enclosing means formed of an electrically and thermally insulating material and formed for positioning around said at least one heating element and between said plate portions of said heat radiation members so as to prevent any liquid from coming into contact with the interior of said heating device; and terminal means attached to said electrode means, operative to permit flow of electric current therethrough, across said interfaces, and via said at least one heating element, thereby producing thermal energy therein and operative to prevent any liquid from coming into contact with the interior of said heating device;

wherein, when an electrical current passes through said electrical heating device, thermal energy from said at least one heating element is conducted across said interfaces to said heat radiation members.

2. An electrical heating device according to claim 1 wherein said contact surfaces of said at least one heating element are coated with a thermally and electrically conductive metal.

3. An electrical heating device according to claim 1 wherein said electrode means comprises said metal-coated inward-facing surfaces of said plate members.

4. An electrical heating device according to claim 1 wherein said electrode means comprises a thermally and electrically conductive metallic sheet with a multiplicity of protuberances to provide spring-like properties thereto.

5. An electrical heating device according to claim 1 wherein said means for fastening comprises compression means.

6. An electrical heating device according to claim 1 wherein said means for fastening comprises an adhesive which is electrically and thermally conductive applied to all said contact surfaces of all said interfaces.

7. An electrical heating device according to claim 1 wherein said terminal means comprises heat-resistant wires.

8. An electrical heating device according to claim 1 wherein said enclosing means comprises a positioning frame and a pair of flanges.

9. An electrical heating device according to claim 8 wherein said at least one heating element comprises at least two heating elements and said enclosing means further comprises spacing members operative to position said at least two heating elements so as to prevent touching contact therebetween.

* * * * *

UNITED STATES PATENT AND TRADEMARK OFFICE

CERTIFICATE OF CORRECTION

PATENT NO. : 6,418,277 B1
DATED : July 9, 2002
INVENTOR(S) : Golan

It is certified that error appears in the above-identified patent and that said Letters Patent is hereby corrected as shown below:

Title page,
Item [75], add to Inventor: -- Yuly Galperin, Holon (IL) --

Signed and Sealed this

Twelfth Day of November, 2002

*Attest:*

*Attesting Officer*

JAMES E. ROGAN
*Director of the United States Patent and Trademark Office*